United States Patent [19]

John, Jr.

[11] 4,140,453

[45] Feb. 20, 1979

[54] PRESS APPARATUS ENCLOSURE ARRANGEMENT

[75] Inventor: Clarence D. John, Jr., Penn Hills, Pa.

[73] Assignee: Westinghouse Electric Corp., Pittsburgh, Pa.

[21] Appl. No.: 836,174

[22] Filed: Sep. 23, 1977

[51] Int. Cl.[2] ..... B30B 11/02

[52] U.S. Cl. ..... 425/151; 425/78; 425/352

[58] Field of Search ..... 425/78, 352, 353, 151; 75/208 R

[56] References Cited

U.S. PATENT DOCUMENTS

| | | | |
|---|---|---|---|
| 1,918,064 | 7/1933 | Taylor | 425/78 X |
| 2,993,786 | 7/1961 | Roboff et al. | 75/208 R |
| 3,156,011 | 11/1964 | Olson | 425/78 X |
| 3,303,533 | 2/1967 | King | 425/78 |
| 3,521,326 | 7/1970 | Rice et al. | 425/78 |
| 3,555,597 | 1/1971 | Meadows | 425/78 |
| 3,732,056 | 5/1973 | Eddy et al. | 425/78 X |
| 3,794,458 | 2/1974 | Iwasaki | 425/353 |
| 3,832,107 | 8/1974 | Cox et al. | 425/78 |
| 3,988,088 | 10/1976 | King et al. | 425/78 |
| 4,005,956 | 2/1977 | Inoue | 425/78 |

*Primary Examiner*—J. Howard Flint, Jr.

*Attorney, Agent, or Firm*—Edward L. Levine; Z. L. Dermer

[57] ABSTRACT

An arrangement for enclosing press apparatus, including a die set and a reciprocating punch block, within a hazardous environment. The die set and punch block are sealed within an enclosure room into which an elongated drive shaft, which connects the punch block and a drive unit, passes. The drive shaft is sealed at the point where it passes from inside to outside of the room, while allowing the shaft to reciprocatingly move. The arrangement provides access to the drive unit for maintenance, external to the hazardous environment and, in the event of a release of hydraulic fluid in an hydraulic drive, the fluid is maintained segregated from the hazardous environment and the material therein.

2 Claims, 1 Drawing Figure

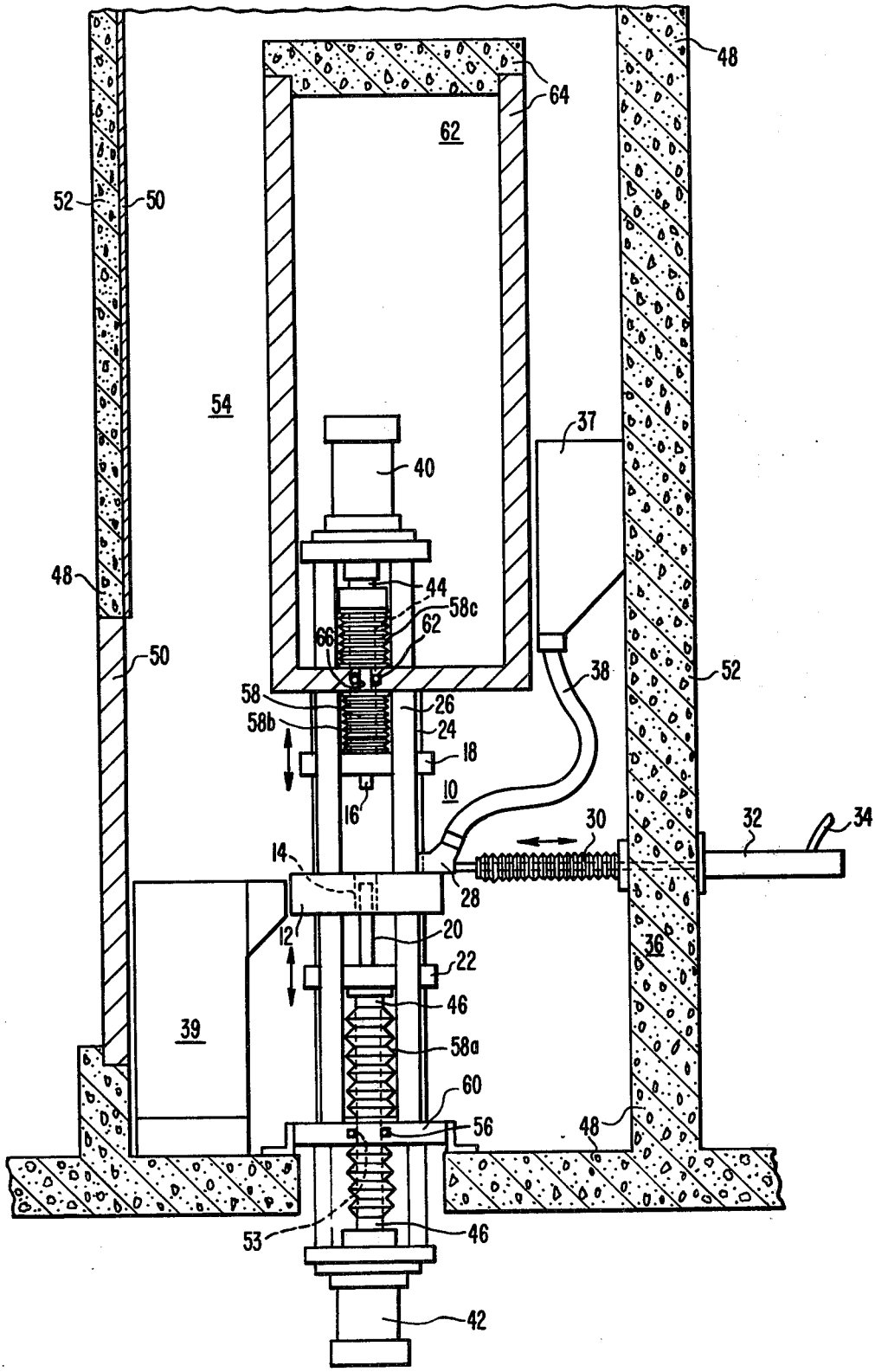
48
64
62
52
50
54
37
40
48
44
58c
62
66
50
38
52
58
26
58b
24
18
10
16
30
32
34
14
28
12
20
36
22
46
39
58a
60
56
48
53
46
42

PRESS APPARATUS ENCLOSURE ARRANGEMENT

BACKGROUND OF THE INVENTION

1. Field of the Invention

This invention relates to enclosures for press apparatus operating within a hazardous environment or upon a hazardous material.

2. Description of the Prior Art

Processes requiring a press to work on hazardous materials, such as various types of nuclear fuel, have in the past either fully enclosed the press within a sealed box, accessible through glove ports, or positioned the entire press in a sealed room accessible only with the use of protective equipment. The protective equipment can include special clothing and breathing apparatus as well as remotely operated manipulators. Access to the press for maintenance, repair or component replacement is accordingly impeded.

Also, where the press utilizes hydraulics there is a possibility that rupture of an hydraulic line or a drive unit seal will spill hydraulic fluid onto components of the press and the material upon which it is operating. Spillage onto the material limits its usefulness. Further, where the material includes certain types of nuclear fuel, such as mixed oxides, being compressed into pellet form, there is some possibility, however remote, that the hydraulic fluid could act as a moderator and support a fission reaction.

Accordingly, it is desirable to provide an arrangement allowing access to press components unimpeded by the hazardous environment. It is also desirable to provide segregation of the hydraulic fluid from the hazardous material upon which the press operates.

SUMMARY OF THE INVENTION

This invention provides an arrangement for enclosing press apparatus within a hazardous environment which allows unimpaired access to selected components of the press, including a drive unit. Where the drive unit is hydraulic, it also separates the hydraulic fluid from the hazardous environment.

In one embodiment the press includes a die set and a punch block which reciprocatingly moves toward and away from the die set during press operation. In a press for forming nuclear fuel pellets from a powdered or granulated fuel, the punch block includes a punch which matingly engages a die in the die set to compress the fuel into pellets. An elongated shaft is affixed to the punch block and is reciprocatingly driven by a drive unit, preferably hydraulic.

The die set and punch block are sealed within a room or enclosure along with other press components, within the hazardous environment. The enclosure is arranged so that the elongated shaft passes from inside to outside the enclosure through an aperture. The hydraulic drive unit is located outside of the enclosure. The shaft is sealed so as to maintain the sealing of the enclosure while allowing the shaft to reciprocatingly move. A flexible bellows, affixed at one extremity to the enclosure about the aperture, and also affixed at the other extremity to, for example, the shaft, is preferably included in the seal arrangement.

In another embodiment both upper and lower punch blocks are utilized in conjunction with respective hydraulic drive units and shafts. One of the drive units, for example the lower, is positioned below the press and outside of the enclosure bounding the die and punch blocks. The lower drive shaft passes through, and is sealed to, the portion of the enclosure between the lower drive unit and punch block. The upper drive unit is contained within a tunnel which passes through the hazardous environment, but which is sealed therefrom. The upper drive shaft is similarly directed through, and sealed to, a wall of the tunnel between the upper punch block and drive unit. In this manner the drive units are accessible for maintenance, and the hydraulic fluid is separated from the hazardous material being operated upon by the press. While the arrangements specifically discussed herein are presented in conjunction with press apparatus in a substantially vertical orientation, it will be apparent that the arrangements are readily adaptable to press apparatus in a horizontal or other orientation.

BRIEF DESCRIPTION OF THE DRAWING

The advantages, nature and additional features of the invention will become more apparent from the following description, taken in connection with the accompanying drawing, in which the sole FIGURE is a side elevational view, partially in section, of an arrangement for enclosing press apparatus.

DESCRIPTION OF THE PREFERRED EMBODIMENTS

Referring now to the FIGURE, there is shown a press 10 including a die set 12. The die set houses at least one die 14 which is sized to matingly receive an upper punch 16 affixed to an upper punch block 18. Also included is a lower punch 20, matingly sized to the die, and affixed to a lower punch block 22. The punch blocks 18, 22 are slidingly positioned on guide bars 24, shown partially hidden in the FIGURE by support bars 26 of the frame of the press.

Also shown are means for placing a working material, such as mixed oxide nuclear fuel, into the die 14, including a laterally reciprocating feeder 28 driven by an arm 30. The arm 30 is preferably driven by an hydraulic cylinder 32 having an hydraulic drive system 34 positioned external to the wall 36. Also included is a feed hopper 37 which feeds granulated or powdered fuel to the feeder 28 through a flexible line 38. The granulated fuel is deposited into the die by the feeder which is then retracted, maintained within the die by the lower punch 20, and compressed into pellet form between the punches 16, 20. The lower punch then pushes the pellets above the die, where they are pushed to collection means such as a conveyor or a receptacle 39, by the feeder in its next cyclic deposition of fuel powder into the die as the lower punch 20 is retracted.

The upper 18 and lower 22 punch blocks are reciprocatingly driven into preselected positions with respect to the die set 12 by, respectively, an upper drive means 40 and lower drive means 42. the drive means can be electrical, mechanical, pneumatic or otherwise, although hydraulic drive units are preferred. The drives 40, 42 are connected to the punch blocks 18, 22 by upper 44 and lower 46 drive shafts.

In accordance with this invention the punch blocks and die set, along with other press apparatus, are sealed within an enclosure 48 which includes wall 36. The enclosure 48, or room, is a confinement or containment barrier for particles or gases, and can include metallic 50 and concrete 52 segments for sealing, structural support and radiation shielding. It can also be provided with a pressure differential across the barrier interface.

The enclosure can be configured in a variety of manners as necessary.

Focusing now on the lower shaft 46, it will be noted that the shaft passes through an aperture 53 in the sealed enclosure 48, thereby being positioned partially within the enclosure and partially outside. Accordingly, while the lower punch block 22 is sealed inside the enclosure, the lower hydraulic drive 42 is positioned external to the enclosure. With this arrangement the drive unit is readily accessible for maintenance, repair or replacement, external to the hazardous environment 54 within the enclosure. Similarly, the hydraulic fluid in the drive unit is sealingly separated from the nuclear fuel or other material upon which the press operates. The lower shaft 46 can be sealed in order to maintain the integrity of the enclosure 48 in varying manners. The sealing means can include O-rings 56 which allow reciprocating sliding motion of the shaft 46, and, desirably included are flexible bellows 58. The bellows can be made of a variety of materials including metals, plastics, and rubbers, the choice of which can be dependent upon the type of hazardous environment. The bellows 58 can be arranged, as shown at 58*a*, affixed to the shaft 46 at one extremity and to a support block 60, within the enclosure 54, at the other extremity. Similarly, as shown at 58*b* and 58*c*, the bellows can be affixed to the punch block and also to the enclosure about the periphery of the aperture through which the drive shaft passes. The bellows can be utilized both inside and outside of the sealed enclosure. A bellows 61 can also be included about the arm 30 and the cylinder 32. In press apparatus having only one punch block and one hydraulic drive, the arrangement described provides desirable separation between the drive unit and the hazardous environment. Where two punch blocks and drive units are utilized, the enclosure also provides desirable separation when oriented so that each of the two associated drive shafts pass from inside to outside the enclosure. Shown in the FIGURE, however, is yet another arrangement beneficially utilized when the hazardous environment is a large area, and the enclosure 48 encompasses additional machinery. Accordingly, in order to have access to, in the exemplary press shown, the upper hydraulic drive unit 40, a sealed access area or tunnel 62 arrangement is provided.

The tunnel 62 passes into an area bounded by the enclosure 48 and the hazardous environment 54, but is sealed and shielded therefrom by its walls 64. Access into the tunnel 62 can be made at a location outside of the enclosed environment at a position not shown in the FIGURE. The tunnel can also be arranged as an alcove, closed at one end and open at the other into the area outside the sealed enclosure. The tunnel 62 is provided with a sealed aperture 66 to allow reciprocating, sliding, sealed motion of the upper shaft 44. In the event of a failure causing discharge of the hydraulic fluid from the upper hydraulic drive unit 40, the fluid is segregated from the hazardous environment and contained within the tunnel. the tunnel or alcove is sized to allow direct manual access to the drive unit.

While the invention has been described with reference to press apparatus in a substantially vertical orientation, which is deemed the best mode of utilization, it will be apparent to those skilled in the art that it can advantageously be applied to press apparatus in a horizontal or other orientation.

There has therefore been described an arrangement for enclosing press components within a hazardous environment while segregating portions of the press from the hazardous area. Many modifications and additions are possible in view of the above teachings. It therefore is to be understood that within the scope of the appended claims, the invention may be practiced other than as specifically described.

I claim:

1. An arrangement for enclosing vertically oriented press apparatus within an environment exposed to nuclear fuel material, said apparatus including a die set and an upper and lower punch block respectively above and below said die set each reciprocatingly movable into a preselected position with respect to said die set respectively from above and below said die set, so as to compress nuclear fuel material disposed within said die set, said arrangement comprising:

(a) an elongated vertical lower shaft affixed to said lower punch block;

(b) an elongated vertical upper shaft affixed to said upper punch block;

(c) upper hydraulic means disposed above said upper punch block for reciprocatingly driving said upper shaft;

(d) lower hydraulic means disposed below said lower punch block for reciprocatingly driving said lower shaft, said lower drive being disposed externally of and sealed from said environment;

(e) means sealingly bounding said environment so as to surround the upper hydraulic means and further including a lower section having an aperture therethrough for slidingly and sealingly receiving said lower shaft; and (f) an access area extending into and sealed from said environment, said access area sealingly enclosing said upper hydraulic drive means and having an aperture therethrough for slidingly and sealingly receiving said upper shaft.

2. The arrangement of claim 1 wherein said access area is sealed from said environment by an o-ring disposed about said upper shaft and further comprising an inner collapsible bellows sealingly affixed about said upper shaft at one end to said upper punch block and at the other end to the outside of said access area, and an outer collapsible bellows sealingly affixed at one end to said upper shaft and at the other end to the inside of said access area.

* * * * *